US009181512B2

(12) United States Patent
Shiflett et al.

(10) Patent No.: US 9,181,512 B2
(45) Date of Patent: Nov. 10, 2015

(54) BIODERIVED BIODEGRADABLE LUBRICANT

(71) Applicants: Mark Shiflett, Wilmington, DE (US); Kurt Mikeska, Hockessin, DE (US)

(72) Inventors: Mark Shiflett, Wilmington, DE (US); Kurt Mikeska, Hockessin, DE (US)

( * ) Notice: Subject to any disclaimer, the term of this patent is extended or adjusted under 35 U.S.C. 154(b) by 25 days.

(21) Appl. No.: 13/712,946

(22) Filed: Dec. 12, 2012

(65) Prior Publication Data

US 2014/0162921 A1 Jun. 12, 2014

(51) Int. Cl.

| | |
|---|---|
| ***C10M 169/04*** | (2006.01) |
| ***C10M 101/04*** | (2006.01) |
| ***C08G 63/00*** | (2006.01) |
| ***C10M 173/02*** | (2006.01) |
| ***C10M 111/04*** | (2006.01) |

(52) U.S. Cl.

CPC ..... *C10M 169/04* (2013.01); *C10M 111/04* (2013.01); *C10M 2205/0285* (2013.01); *C10M 2207/025* (2013.01); *C10M 2207/026* (2013.01); *C10M 2207/126* (2013.01); *C10M 2207/401* (2013.01); *C10M 2209/1033* (2013.01); *C10N 2220/022* (2013.01); *C10N 2230/02* (2013.01); *C10N 2230/06* (2013.01); *C10N 2230/62* (2013.01); *C10N 2240/06* (2013.01)

(58) Field of Classification Search

CPC ..... C10M 2205/02; C10M 2207/401; C10M 107/34; C10M 2209/1013; C10M 2209/1033

USPC ..... 508/488, 456, 491, 494, 507

See application file for complete search history.

(56) References Cited

U.S. PATENT DOCUMENTS

| | | | | |
|---|---|---|---|---|
| 5,102,567 | A | 4/1992 | Wolf | |
| 5,472,625 | A | 12/1995 | Maples | |
| 5,670,463 | A | 9/1997 | Maples | |
| 5,885,947 | A | 3/1999 | Maples | |
| 5,898,022 | A | 4/1999 | Maples | |
| 6,245,722 | B1 | 6/2001 | Maples et al. | |
| 6,398,986 | B1 * | 6/2002 | McShane et al. | 252/579 |
| 2010/0105583 | A1 * | 4/2010 | Garmier | 508/155 |
| 2013/0095141 | A1 * | 4/2013 | Schad et al. | 424/400 |

* cited by examiner

*Primary Examiner* — Vishal Vasisth

(74) *Attorney, Agent, or Firm* — Stamoulis & Weinblatt LLC

(57) ABSTRACT

A multi-purpose lubricant is described. In accordance with one implementation, a lubricant comprises food grade based oils substantially complying with USDA H-1 specifications for incidental contact with food, wherein at least one oil is selected from the group consisting of food grade plant oil, food grade poly-alpha-olefin, polyalkylene glycol, and mixtures thereof. In accordance with another implementation, a lubricant comprises canola oil, castor oil and a poly-alpha-olefin. In accordance with yet another implementation, a lubricant comprises canola oil, castor oil and a polyalkylene glycol. In accordance with yet another implementation, a lubricant comprises an oil substantially complying with USDA H-2 specification wherein the oil is at least one item selected from the group consisting of plant oil, poly-alpha-olefin, polyalkylene glycol, and mixtures thereof. In some implementations, the multi-purpose lubricant may be applied to areas of a bicycle chain.

21 Claims, 1 Drawing Sheet

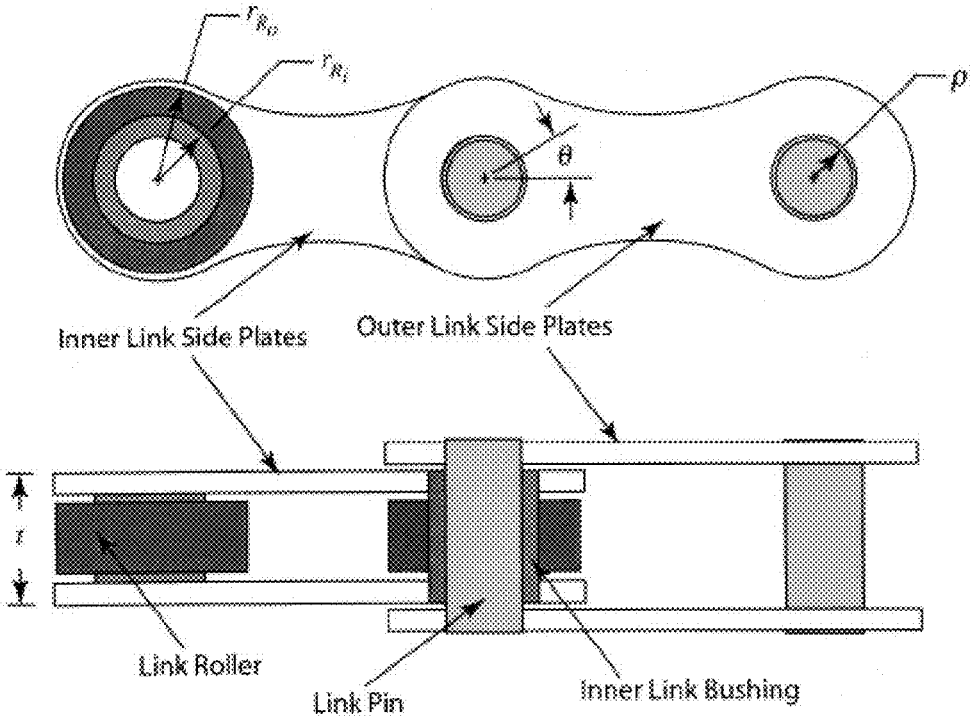
$r_{R_o}$
$r_{R_i}$
$\rho$
$\theta$
Inner Link Side Plates
Outer Link Side Plates
$t$
Link Roller
Link Pin
Inner Link Bushing

BIODERIVED BIODEGRADABLE LUBRICANT

TECHNICAL FIELD

This application relates in general to lubricants.

BACKGROUND

A bicycle chain is a roller chain that transfers power from the pedals to the drive-wheel of a bicycle which propels it. Many bicycle chains are made from plain carbon or alloy steel with some plated with nickel for example to reduce rust and allow for some self-lubrication. Bicycle chains come in a variety of shapes and sizes and most are often referred to as roller chains. Roller chains are one of the most efficient and cost effective ways to transmit mechanical power between two shafts (i.e. the bicycle crank shaft and the rear axle). The general construction of a roller chain consists of two alternating link assemblies and when put together create a chain segment. The outer link assembly usually consists of two outer link side plates containing two link pins. The inner link assembly usually consists of two inter link bushings and two link rollers. Therefore one chain segment usually consists of eight separate components with six moving contact points. FIG. 1 is a schematic of a chain link segment.

An average bicycle chain has about forty to fifty segments, therefore 320 to 400 separate components with 240 to 300 moving parts and all of these parts are directly exposed to the environment (e.g., water and dirt).

A variety of mechanisms exist for reducing the transfer of power in the chain drive. Frictional, impact and chain deformation are the predominant energy loss mechanisms. Frictional losses cannot be recovered during operation and this energy is dissipated as heat. Impact losses describe the interactions between the chain and the sprockets and chain deformation results from the offset angle of the chain. Frictional losses account for the majority of the energy loss and are a product of the coefficient of friction and the normal force acting over the contacting chain surfaces.

The following may be useful to the reader:

Plant-derived oils are defined as oils that were produced from plant sources, as opposed to animal fats or petroleum. There are three primary types of plant oils, differing both by the means of extracting the relevant parts of the plant, and in the nature of the resulting oil. (1) Vegetable oils are historically extracted by putting part of the plant under pressure and squeezing out the oil. (2) Macerated oils consist of a base oil to which parts of plants are added and (3) essential oils are composed of volatile aromatic compounds, extracted from plants by distillation.

Vegetable oils are what are most commonly considered plant oils. These are triglyceride-based and include oils such as canola oil, soybean oil, sesame seed oil, rape seed oil, peanut oil, palm oil, olive oil, neatstool oil, menhadden oil, linseed oil, cotton seed oil, corn oil, coconut oil, sunflower oil, safflower oil and castor oil to name a few. The oils are extracted from the plant (usually the seed) by compressing the plant under pressure.

Canola oil is a vegetable oil which refers to a cultivar of either rapeseed (*Brassica napus* L.) or field mustard (*Brassica campestris* L. or *Brassica Rapa* var.). Canola oil is a pale yellow liquid with a mild or no odor or taste. Its boiling point is 225° F. (107° C.) with a density of 910 kg/m$^3$. It has a flash point of 600° F. (315° C.). Its seeds are used to produce edible oil suitable for consumption by humans. Canola oil can be obtained from several commercial sources including ADM Agri-Industries, Ltd. (Decatur, Ill.) and Cargill, Inc. (Minneapolis, Minn.).

Castor oil is a vegetable oil obtained from the castor bean (i.e. castor seed), *Ricinus communis* (Euphorbiaceae). Castor oil is a colorless to pale yellow liquid with mild or no odor or taste. Its boiling point is 595° F. (313° C.) with a density of 961 kg/m$^3$. It has a flash point of about 445° F. (229° C.). Its seeds are used to produce edible oil suitable for consumption by humans. Castor oil can be obtained from several commercial sources including Welch, Holme & Clark Company, Inc. (Newark, N.J.) and Jedwards International, Inc. (Quincy, Mass.).

Mineral oil is any various colorless, odorless, light mixture of alkanes in the $C_{15}$ to $C_{40}$ range from a non-vegetable (mineral) source particularly a distillate of petroleum. Other names such as white oil, liquid paraffin and liquid petroleum have been used. Refined mineral oil can be purified and certain grades are safe for human consumption. Mineral oil can be substituted for some plant oil content in the disclosed invention.

Polyolefin is a polymer produced from a simple olefin called an alkene with the general formula $C_nH_{2n}$. For example, polyethylene is the polyolefin produced by polymerizing the olefin ethylene. Polyolefins have chemical resistance and very low surface energies. Polyolefins with 15 or less carbons are more likely to be soluble in plant-based oils and produce lubricants with a viscosity suitable for bicycle chain applications.

Poly-alpha-olefin is a specific type of polyolefin where the carbon-carbon double bond starts at the alpha-carbon atom (i.e. the double bond is between the first and second carbons in the molecule). Many poly-alpha-olefins are safe for human contact. A few examples of poly-alpha-olefins which are food-grade compatible (H-1) include CAMCO FMO-5, FMO-15, FMO-32, FMO-46 and FMO-100 from CAMCO Lubricants (St. Paul, Minn.) and Omnilube FGH 1022, FGH 1032, FGH 1046, FGH 1068, FGH 1100 and FGH 1150 from UltraChem, Inc. (New Castle, Del.).

Polyalkylene glycol is a specific type of condensation polymer from ethylene oxide and water. Polyalkylene glycols generally have much better load and wear properties compared to petroleum oils and poly-alpha-olefins. A few examples of polyalkylene glycols which are food-grade compatible (H-1) include PG 130 FG and PG 220 FG from UltraChem, Inc.

BioBlend MP22 is a biodegradable plant-based oil which is used for a variety of applications including chain and cable applications. BioBlend MP22 is produced by BioBlend Renewable Resources, LLC (Joliet, Ill.).

Antioxidants inhibit oxidation of molecules. Oxidation is a chemical reaction that transfers electrons or hydrogen from a substance to an oxidizing agent. Oxidation reactions can produce free radicals which in turn can start chain reactions. Antioxidants are important in lubricants and can prevent the formation of gums that interfere with the operation of the lubricating surfaces. There are hundreds of water and oil soluble antioxidants. Many food grade phenolic-based and aromatic amine-based antioxidants exist. A few examples of oil soluble antioxidants which are safe for human contact include vitamin E, butylated hydroxytoluene, butylated hydroxyanisole, and omega 3 fatty acids. Vitamin E is the collective name for a set of eight related tocopherols and tocotrienols with antioxidant properties. Omega 3 fatty acids are a blend of docosahexaenoic acid (DHA) and eicosapentaenoic acid (EPA).

Aqueous soluble dyes which are food grade compatible include Food, Drug and Cosmetic (FC&C) dyes such as FD&C #40 (red), FD&C #3 (red), FD&C #5 (yellow), FD&C #6 (orange), FD&C #1 (Blue), FD&C #2 (Blue), FD&C #3 (Green), Orange B and Citrus Red #2. Oil soluble dyes which are safe for human contact include Drug and Cosmetic dyes such as D&C #6 (green), D&C #17 (red), D&C #11 (yellow) and D&C #2 (violet). The dyes are available from Sensient Colors, Inc. and Spectra Colors Corporation. Some aqueous soluble dyes maybe used by first dissolving in propylene glycol or other suitable solvent before dissolving in the plant based oils.

Bioderived is defined to mean the mixture contains equal to or greater than 77 weight percent of a biobased product. The USDA BioPreferred program requires chain and cable lubricants to contain equal to or greater than 77 weight percent of a biobased product.

Biobased is defined to mean a product that contains organic carbon. In other words, carbon that did not originate from petroleum or petroleum-based products. The biobased content can be determined by measuring the amount of carbon-13 in the product using ASTM Method D6866, Standard Test Methods for Determining the Biobased Content of Natural Range Materials Using Radiocarbon and Isotope Ratio Mass Spectrometry Analysis.

Flammable liquid is defined as one with a flash point below 100° F. (37.8° C.). Less-flammable liquids with a flash point between 100° F. (37.8° C.) and 200° F. (93.3° C.) are defined as combustible liquids. This definition is used by the National Fire Protection Association, the U.S. Department of Transportation, the U.S. Environmental Protection Agency, the U.S. Occupational Safety the Health Administration and others.

NSF International is a not-for-profit, non-governmental organization that provides standards development, product certification, auditing, education and risk management for public health and safety. NSF is a World Health Organization collaborating center for food and water safety and indoor environment.

Food Grade Lubricants are acceptable for use in meat, poultry and other food processing equipment, applications and plants. The lubricant types in food-grade applications are broken into categories based on the likelihood they will contact food. The USDA created the original food-grade designations H1, H2 and H3, which is the current terminology used. The approval and registration of a new lubricant into one of these categories depends on the ingredients used in the formulation.

H1 Lubricant is a food-grade lubricant used in food processing environments where there is some possibility of incidental food contact. Lubricant formulations may only be composed of one or more approved basestocks, additives and thickeners listed in Guidelines of Security Code of Federal Regulations (CFR) Title 21, 178.3570.

H2 Lubricant is a lubricant used on equipment and machine parts in locations where there is no possibility that the lubricant or lubricated surface contacts food. Because there is not the risk of contacting food, it does not have a defined list of acceptable ingredients. They cannot, however, contain intentionally added heavy metals such as antimony, arsenic, cadmium, lead, mercury or selenium. Also, the ingredients must not include substances that are carcinogens, mutagens, teratogens or mineral acids.

H3 Lubricant is a lubricant also known as a soluble or edible oil. It is used to clean and prevent rust on hooks, trolleys, and similar equipment.

Biodegradable is the chemical breakdown of the base oil and additives into carbon dioxide and water, in the presence of organisms, air, and water.

Inherently Biodegradable means at least 20% of the product will have biodegraded in 28 days or less.

Readily Biodegradable or Ultimately Biodegradable means that 60% or more of the product will have biodegraded in 28 days or less.

SUMMARY

This application relates to a multi-purpose lubricant which is formulated for use on items, such as, but notwithstanding, bicycle chains that is bioderived, nonflammable, biodegradable, and environmentally safe with a low coefficient of friction and lubricant loss rate. The lubricant during use may also attract and retain minimal dirt particles and is easy to clean from the chain surfaces.

In accordance with one implementation, a lubricant comprises food grade based oils substantially complying with USDA H-1 specifications for incidental contact with food, wherein at least one oil is selected from the group consisting of food grade plant oil, food grade poly-alpha-olefin, polyalkylene glycol, and mixtures thereof.

In accordance with another implementation, a lubricant comprises canola oil, castor oil and a poly-alpha-olefin.

In accordance with yet another implementation, a lubricant comprises canola oil, castor oil and a polyalkylene glycol.

In accordance with yet another implementation, a lubricant comprises an oil substantially complying with USDA H-2 specification wherein the oil is at least one item selected from the group consisting of plant oil, poly-alpha-olefin, polyalkylene glycol, and mixtures thereof.

The details of one or more implementations are set forth in the accompanying drawing and the description below. Other features, aspects, and advantages will become apparent from the description, the drawing, and the claims. It is to be understood that the foregoing general description and the detailed description are exemplary, but not restrictive of the lubricant or the method for making the lubricant.

DESCRIPTION OF DRAWINGS

In the drawing, which is discussed herein, an implementation of a chain link segment is illustrated. It is understood that the lubricant is not limited to being applied to the implementation depicted in the drawing, but rather may be used on other types of chains, equivalent structures or items to be lubricated.

FIG. 1 shows a schematic of a chain link segment.

DETAILED DESCRIPTION

While the specification concludes with claims particularly pointing out and distinctly claiming subject matter, the lubricant will now be further described by reference to the following detailed description of exemplary implementations taken in conjunction with the above-described accompanying drawing. The following description is presented to enable any person skilled in the art to make and use the lubricant. Descriptions of specific implementations and applications are provided only as non-limiting examples and various modifications will be readily apparent to those skilled in the art. The general principles defined herein may be applied to other implementations and applications without departing from the spirit and scope of the lubricant. Thus, the lubricant is to be accorded the widest scope encompassing numerous alternatives, modifications, and equivalents consistent with the principles and features disclosed herein. For purpose of clarity, details relating to technical material that is known in the technical fields related to the lubricant have not been described in detail so as not to unnecessarily obscure the present application.

In some implementations, a lubricant for bicycle chains and other mechanisms is made by combining canola oil, castor oil and a poly-alpha-olefin or polyalkylene glycol. In some implementations, this combination forms a thin, penetrating multi-function film over the entire chain mechanism by balancing a combination of properties including chain wet ability, metal affinity, anti-wear and anti-friction elements.

In some implementations, the canola oil is plant-derived. Canola oil has lubricating properties, including chain wet ability and low coefficient of friction. In some implementations, the canola oil content may vary from about 1 to about 80 weight percent.

In some implementations, the castor oil is plant-derived. It is a triglyceride and has a great affinity for metal surfaces. Castor oils also have lubrication properties, including good low temperature viscosity properties. In some implementations, the castor oil content may vary from about 1 to about 75 weight percent. In some implementations, higher concentrations of castor oil may be used, but in some cases depending on the amount of poly-alpha-olefin present, the mixture may form two phases. For example, a mixture containing about 77 weight percent castor oil, about 20 weight percent poly-alpha-olefin and about 3 weight percent canola oil may separate into two-phases. Ideally the lubricant components remain completely miscible, but in the event the lubricant components separate, the user would shake the bottle before use to ensure a uniform mixture was applied to the bicycle chain or mechanism to be lubricated.

Regarding the poly-alpha-olefin or polyalkylene glycol, many poly-alpha-olefins have flexible alkyl branching groups on every other carbon of their polymer backbone chain. These alkyl groups which can shape themselves in numerous conformations make it difficult for the polymer molecules to line themselves up side-by-side in an orderly way. Therefore, many poly-alpha-olefins do not crystallize or solidify easily and are oily, viscous liquids even at low temperature. At least for these reasons, low molecular weight poly-alpha-olefins are synthetic lubricants with low coefficient of friction and anti-wear properties.

In some implementations, the poly-alpha-olefin content may vary from about 1 to about 20 weight percent. In some implementations, higher concentrations of poly-alpha-olefin may be used, but in some cases depending on the amount of castor oil present, the mixture may form two phases. For example, a mixture containing about 40 weight percent poly-alpha-olefin, about 50 weight percent castor oil and about 10 weight percent canola oil may separate into two phases. Ideally the lubricant components remain completely miscible, but in the event the lubricant components separate, the user would shake the bottle before use to ensure a uniform mixture was applied to the bicycle chain or mechanism to be lubricated. In some implementations, a polyalkylene glycol may be used instead of or in addition to the poly-alpha-olefin. Polyalkylene glycols are lubricants having a low coefficient of friction and anti-wear properties. Polyalkylene glycols also generally perform better at higher temperatures than poly-alpha-olefins. Mixtures of poly-alpha-olefins and polyalkylene glycols may also be used in combination with canola oil and castor oil.

In order to measure the chain drive efficiency and study the effect of lubrication on chain link performance, a test stand was constructed. The stand consisted of two shafts connected by a standard bicycle chain. The front shaft was driven by an adjustable speed motor with a speed and power sensor and was connected to a standard Shimano bicycle front chain ring with 52 teeth. The rear shaft was connected to a second power sensor with a standard Shimano rear cassette and derailleur unit. The rear cassette had ten chain rings with 11, 12, 14, 15, 17, 18, 19, 21, 23 and 25 teeth. The rear shaft also was connected to a mechanical braking system and a tensioner so that a constant load could be applied to simulate actually riding conditions. To determine the chain drive efficiency, the ratio of the power output divided by the power input was calculated at several speeds and power outputs with various gear ratios using the rear cassette.

The standard conditions selected for comparison to determine the improvements with and without lubrication on the chain were 60 revolutions per minute (rpm) with a front shaft power output of 100 watts (W) using the 52/15 front ring/cassette ring combination. A baseline experiment was conducted with a clean dry chain with no lubricant which resulted in a chain drive efficiency of about 90±1%.

The same experiment was repeated after applying a lubricant to the chain comprising a mixture of canola oil, castor oil and a poly-alpha-olefin (PAO) or polyalkylene glycol (PAG). In some implementations, an antioxidant and dye were added to reduce oxidation and alter the color of the otherwise pale yellow to clear oils. In some implementations, the antioxidant content may vary from 0 to 5 weight percent and the dyes from 0 to 0.1 weight percent.

Examples 1 to 6 measure the chain drive efficiency performance of mixtures containing canola oil, castor oil and PAO with and without additives. Examples 7 to 9 measure the chain drive efficiency performance of mixtures containing canola oil and lubricant additives purchased from BioBlend Renewable Resources with castor oil in various proportions. Examples 10 to 15 measure the chain drive efficiency performance of mixtures containing canola oil, castor oil and PAG with and without additives. In all cases the chain drives efficiency improved by 1 to 3%.

EXAMPLE 1

A lubricant containing about 80 weight percent food grade canola oil, 10 weight percent food grade castor oil and 10 weight percent poly-alpha-olefin (Omnilube FGH 1022) was mixed together for twenty minutes to form a miscible solution at room temperature. The lubricant had a density of about 0.9 g $cm^{-3}$ and a viscosity of about 50 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 93±1%. The chain was carefully removed and the weight compared before and after operation. The lubricant mass loss was calculated to be about 2.3±0.5%.

EXAMPLE 2

A lubricant containing about 80 weight percent food grade canola oil, 10 weight percent food grade castor oil, 9 weight percent poly-alpha-olefin (Omnilube FGH 1022), 0.95 weight percent vitamin E antioxidant and 0.05 weight percent annatto dye was mixed together for twenty minutes to form a miscible yellow solution at room temperature. The lubricant had a density of about 0.9 g $cm^{-3}$ and a viscosity of about 50 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 93±1%. The chain was carefully removed and the weight compared before and after operation. The lubricant mass loss was calculated to be about 2.4±0.5%.

EXAMPLE 3

A lubricant containing about 45 weight percent food grade canola oil, 45 weight percent food grade castor oil and 10 weight percent poly-alpha-olefin (Omnilube FGH 1032) was mixed together for twenty minutes to form a miscible solution at room temperature. The lubricant had a density of about 0.9 g $cm^{-3}$ and a viscosity of about 200 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 92±1%. The chain was carefully removed and the weight compared before and after operation. The lubricant mass loss was calculated to be about 1.7±0.5%.

EXAMPLE 4

A lubricant containing about 45 weight percent food grade canola oil, 45 weight percent food grade castor oil, 9 weight percent poly-alpha-olefin (Omnilube FGH 1032), 0.93 weight percent omega 3 fatty acid antioxidant and 0.07 weight percent chlorophyll dye was mixed together for twenty minutes to form a green miscible solution at room temperature. The lubricant had a density of about 0.9 g $cm^{-3}$ and a viscosity of about 200 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 92±1%. The chain was carefully removed and the weight compared before and after operation. The lubricant mass loss was calculated to be about 1.9±0.5%.

EXAMPLE 5

A lubricant containing about 15 weight percent food grade canola oil, 75 weight percent food grade castor oil and 10 weight percent poly-alpha-olefin (Omnilube FGH 1022) was mixed together for twenty minutes to form a miscible solution at room temperature. The lubricant had a density of about 0.9 g $cm^{-3}$ and a viscosity of about 400 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 91±1%. The chain was carefully removed and the weight compared before and after operation. The lubricant mass loss was calculated to be about 1.5±0.5%.

EXAMPLE 6

A lubricant containing about 15 weight percent food grade canola oil, 75 weight percent food grade castor oil, 9 weight percent poly-alpha-olefin (Omnilube FGH 1022), 0.92 weight percent butylated hydroxyanisole antioxidant and 0.08 weight percent paprika oleoresin dye was mixed together for twenty minutes to form a red miscible solution at room temperature. The lubricant had a density of about 0.9 g $cm^{-3}$ and a viscosity of about 400 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 91±1%. The chain was carefully removed and the weight compared before and after operation. The lubricant mass loss was calculated to be about 1.5±0.5%.

EXAMPLE 7

A lubricant containing about 75 weight percent BioBlend MP22 and 25 weight percent food grade castor oil was mixed together for twenty minutes to form a miscible solution at room temperature. The lubricant had a density of about 0.9 g $cm^{-3}$ and a viscosity of about 100 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 92±1%. The chain was carefully removed and the weight compared before and after operation. The lubricant mass loss was calculated to be about 2.0±0.5%.

EXAMPLE 8

A lubricant containing about 50 weight percent BioBlend MP22 and 50 weight percent food grade castor oil was mixed together for twenty minutes to form a miscible solution at room temperature. The lubricant had a density of about 0.9 g $cm^{-3}$ and a viscosity of about 200 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 92±1%. The chain was carefully removed and the weight compared before and after operation. The lubricant mass loss was calculated to be about 1.8±0.5%.

EXAMPLE 9

A lubricant containing 25 weight percent BioBlend MP22 and 75 weight percent food grade castor oil was mixed together for twenty minutes to form a miscible solution at room temperature. The lubricant had a density of about 0.9 g $cm^{-3}$ and a viscosity of about 400 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 91±1%. The chain was carefully removed and the weight compared before and after operation. The lubricant mass loss was calculated to be about 1.6±0.5%.

EXAMPLE 10

A lubricant containing about 80 weight percent food grade canola oil, 10 weight percent food grade castor oil and 10 weight percent polyalkylene glycol (Omnilube PG 130 FG) was mixed together for twenty minutes to form a miscible solution at room temperature. The lubricant had a density of about 0.9 g $cm^{-3}$ and a viscosity of about 55 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 93±1%. The chain was carefully removed and the weight compared before and after operation. The lubricant mass loss was calculated to be about 2.2±0.5%.

EXAMPLE 11

A lubricant containing about 80 weight percent food grade canola oil, 10 weight percent food grade castor oil, 9 weight percent polyalkylene glycol (Omnilube PG 130 FG), 0.97 weight percent vitamin E antioxidant and 0.03 weight percent D&C Yellow #11 was mixed together for twenty minutes to form a miscible yellow solution at room temperature. The lubricant had a density of about 0.9 g $cm^{-3}$ and a viscosity of about 55 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 93±1%. The chain was carefully removed and the weight compared before and after operation. The lubricant mass loss was calculated to be about 2.3±0.5%.

EXAMPLE 12

A lubricant containing about 40 weight percent food grade canola oil, 50 weight percent food grade castor oil and 10 weight percent polyalkylene glycol (Omnilube PG 130 FG) was mixed together for twenty minutes to form a miscible solution at room temperature. The lubricant had a density of about 0.9 g $cm^{-3}$ and a viscosity of about 220 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 92±1%. The chain was carefully removed and the weight compared before and after operation. The lubricant mass loss was calculated to be about 1.6±0.5%.

EXAMPLE 13

A lubricant containing about 40 weight percent food grade canola oil, 50 weight percent food grade castor oil, 9 weight percent polyalkylene glycol (Omnilube PG 130 FG), 0.98 weight percent omega 3 fatty acid antioxidant and 0.02 weight percent D&C Green #6 was mixed together for twenty minutes to form a green miscible solution at room temperature. The lubricant had a density of about 0.9 g $cm^{-3}$ and a viscosity of about 220 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 92±1%. The chain was carefully removed and the weight compared before and after operation. The lubricant mass loss was calculated to be about 1.7±0.5%.

EXAMPLE 14

A lubricant containing about 10 weight percent food grade canola oil, 80 weight percent food grade castor oil and 10 weight percent polyalkylene glycol (Omnilube PG 130 FG) was mixed together for twenty minutes to form a miscible solution at room temperature. The lubricant had a density of about 0.9 g $cm^{-3}$ and a viscosity of about 450 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 91±1%. The chain was carefully removed and the weight compared before and after operation. The lubricant mass loss was calculated to be about 1.2±0.5%.

EXAMPLE 15

A lubricant containing about 10 weight percent food grade canola 80 weight percent food grade castor oil, 9 weight percent polyalkylene glycol (Omnilube PG 130 FG), 0.99 weight percent butylated hydroxyanisole antioxidant and 0.01 weight percent D&C red #17 dye was mixed together for twenty minutes to form a red miscible solution at room temperature. The lubricant had a density of about 0.9 g $cm^{-3}$ and a viscosity of about 450 centipoise at 21 degrees Celsius. The lubricant mixture was applied to a bicycle chain and the excess wiped off with a rag, leaving behind a thin film of lubricant. The bike chain was installed in a test stand to measure the mass and frictional loss. The drive chain efficiency was measured at about 100 watts and 60 rpm to be about 91±1%. The chain was carefully removed and the weight compared before and after operation. The lubricant mass loss was calculated to be about 1.3±0.5%.

A lubricant mixture containing about 80 weight percent canola oil, 10 weight percent castor oil and 10 weight percent poly-alpha-olefin with and without antioxidant and dye showed an improvement in chain drive efficiency of about 3±1%. A lubricant mixture containing about 45 weight percent canola oil, 45 weight percent castor oil and 10 weight percent poly-alpha-olefin with and without antioxidant and dye showed an improvement in chain drive efficiency of about 2±1%. A lubricant mixture containing about 15 weight percent canola oil, 75 weight percent castor oil and 10 weight percent poly-alpha-olefin with and without antioxidant and dye showed an improvement in chain drive efficiency of about 1±1%.

A lubricant mixture containing about 75 weight percent BioBlend MP22 and 25 weight percent castor oil showed an improvement in chain drive efficiency of about 2±1%. A lubricant mixture containing about 50 weight percent BioBlend MP22 and 50 weight percent castor oil showed an improvement in chain drive efficiency of about 2±1%. A lubricant mixture containing about 25 weight percent BioBlend MP22 and 75 weight percent castor oil showed an improvement in chain drive efficiency of about 1±1%.

A lubricant mixture containing about 80 weight percent canola oil, 10 weight percent castor oil and 10 weight percent polyalkylene glycol with and without antioxidant and dye showed an improvement in chain drive efficiency of about 3±1%. A lubricant mixture containing about 40 weight percent canola oil, 50 weight percent castor oil and 10 weight percent polyalkylene glycol with and without antioxidant and dye showed an improvement in chain drive efficiency of about 2±1%. A lubricant mixture containing about 10 weight percent canola oil, 80 weight percent castor oil and 10 weight percent polyalkylene glycol with and without antioxidant and dye showed an improvement in chain drive efficiency of about 1±1%.

The viscosity of a lubricant is an important factor in determining the lubricant-film thickness. A critical film thickness is required in order to minimize the coefficient of friction. If the lubricant is too thin, the film thickness may become too small and friction may increase. If the lubricant is too thick, it may become difficult for the lubricant to penetrate into and between the links and rollers and surface wettability may decrease leading to an increase in friction.

Examples 1 to 15 also show a correlation exists between the lubricant's absolute viscosity and the chain drive efficiency. The density and viscosity of each lubricant mixture was measured using a pycnometer and rheometer, respectively, at room temperature (about 70° F. or about 21° C.). The mixture containing 80 weight percent canola oil, 10 weight percent castor oil and 10 weight percent poly-alpha-olefin had an absolute viscosity of about 50 centipoise at room temperature. The mixture containing 45 weight percent canola oil, 45 weight percent castor oil and 10 weight percent poly-alpha-olefin had an absolute viscosity of about 200 centipoise at room temperature. The mixture containing 15 weight percent canola oil, 75 weight percent castor oil and 10 weight percent poly-alpha-olefin had an absolute viscosity of about 400 centipoise at room temperature. The mixture containing 25 weight percent BioBlend MP22 and 75 weight percent castor oil had an absolute viscosity of about 400 centipoise at room temperature. The mixture containing 50 weight percent BioBlend MP22 and 50 weight percent castor oil had an absolute viscosity of about 200 centipoise at room temperature. The mixture containing 75 weight percent BioBlend MP22 and 25 weight percent castor oil had an absolute viscosity of about 100 centipoise at room temperature. The mixture containing 80 weight percent canola oil, 10 weight percent castor oil and 10 weight percent polyalkylene glycol had an absolute viscosity of about 55 centipoise at room temperature. The mixture containing 40 weight percent canola oil, 50 weight percent castor oil and 10 weight percent polyalkylene glycol had an absolute viscosity of about 220 centipoise at room temperature. The mixture containing 10 weight percent canola oil, 80 weight percent castor oil and 10 weight percent polyalkylene glycol had an absolute viscosity of about 450 centipoise at room temperature. The ideal absolute viscosity range for many riding styles and environmental conditions is about 50 to 450 centipoise at room temperature.

The lubricants' ability to adhere to the chain is another parameter to be considered. The lubricant should remain on the chain while in motion and not "fly-off" the surface of the chain. If the lubricant viscosity is below about 50 centipoise, it has a greater tendency to "fly-off" the chain because it is too thin. The lubricants' adherence was measured by carefully weighing the dry chain, applying lubricant on the chain and using a rag to wipe off any excess lubricant. The chain was mounted in the test stand which was run for about 1 hour at 60 rpm, 100 watt load in the 52/15 front ring/cassette ring combination. Examples 1 to 15 demonstrate several mixtures which were prepared and the lubricant mass loss measured. In all cases the chain lost some lubricant from about 1.5% to 2.3%.

A lubricant mixture containing 80 weight percent canola oil, 10 weight percent castor oil and 10 weight percent poly-alpha-olefin with and without antioxidant and dye had an average lubricant mass loss of 2.3±0.5%. A lubricant mixture containing 45 weight percent canola oil, 45 weight percent castor oil and 10 weight percent poly-alpha-olefin with and without antioxidant and dye had an average lubricant mass loss of 1.8±0.5%. A lubricant mixture containing 15 weight percent canola oil, 75 weight percent castor oil and 10 weight percent poly-alpha-olefin with and without antioxidant and dye had an average lubricant mass loss of 1.5±0.5%. A lubricant mixture containing 75 weight percent BioBlend MP22 and 25 weight percent castor oil had an average lubricant mass loss of 2.0±0.5%. A lubricant mixture containing 50 weight percent BioBlend MP22 and 50 weight percent castor oil had an average lubricant mass loss of 1.8±0.5%. A lubricant mixture containing 25 weight percent BioBlend MP22 and 75 weight percent castor oil had an average lubricant mass loss of 1.6±0.5%. A lubricant mixture containing 80 weight percent canola oil, 10 weight percent castor oil and 10 weight percent polyalkylene glycol with and without antioxidant and dye had an average lubricant mass loss of 2.2±0.5%. A lubricant mixture containing 40 weight percent canola oil, 50 weight percent castor oil and 10 weight percent polyalkylene glycol with and without antioxidant and dye had an average lubricant mass loss of 1.6±0.5%. A lubricant mixture containing 10 weight percent canola oil, 80 weight percent castor oil and 10 weight percent polyalkylene glycol with and without antioxidant and dye had an average lubricant mass loss of 1.2±0.5%.

Therefore a balance of properties may be used when formulating a multi-purpose lubricant. In some implementations, the multi-purpose lubricant may be used for bicycle chains. The canola oil provides chain wet ability and a low coefficient of friction. Mixtures containing high content of canola oil (about 80 weight percent) showed the highest chain drive efficiency (3% improvement); however this may be balanced with the lubricant mass loss which also was high at about 2.3%. The castor oil provides lubrication and affinity for metal surfaces with low mass loss of about 1.5%; however this may be balanced with the lower chain drive efficiency (1% improvement). A mixture containing 45 weight percent canola oil, 45 weight percent castor oil and 10 weight percent of poly-alpha-olefin may provide an overall balance between chain drive efficiency (2% improvement) and lubricant mass loss (1.8%). The same is true for a mixture containing 40 weight percent canola oil, 50 weight percent castor oil and 10 weight percent of polyalkylene glycol with the best overall balance between chain drive efficiency (2% improvement) and lubricant mass loss (1.6%). As mentioned earlier, another component of the lubricant mixture is a poly-alpha-olefin or polyalkylene glycol. Because plant oils can oxidize over time and become gummy, the addition of the poly-alpha-olefin or polyalkylene glycol reduces gum formation. These additives also reduce the coefficient of friction and improve the thermal and oxidative stability of the mixture. Additional antioxidants and dyes also may be added. The mixtures containing BioBlend MP22 perform in a similar fashion to those using canola oil.

In some implementations, a blend of canola oil and castor oil with poly-alpha-olefins and polyalkylene glycols minimizes gum formation. In some implementations, in order to prevent gum formation at temperatures experienced with normal bicycle operation (i.e. about 0 to 120° F. or −18 to 49° C.) in air, at least about 2 weight percent poly-alpha-olefin or polyalkylene glycol or mixtures of both should be added. Other commercially available oils such as BioBlend MP22 may be substituted for canola oil in the formulations set forth herein.

In some implementations, the canola oil and castor oil may be bioderived. In some implementations, the combined mass of the canola and castor oils may be at least 77 weight percent so that the environmental impact of the lubricant may be minimized. The USDA BioPreferred program has established for chain and cable lubricants a minimum bioderived content of 77 weight percent. In some implementations, the poly-alpha-olefin and polyalkylene glycol may be either bioderived or synthetic. In some implementations, the poly-alpha-olefin and polyalkylene glycol may be a combination of bioderived and synthetic.

In some implementations, the lubricant mixture may be nonflammable. Canola oil, castor oil, most poly-alpha-olefins ($C_6$ to $C_{14}$) and polyalkylene glycols have a boiling point and flash point which exceed 200° F. (93.3° C.); therefore they are defined as combustible liquids and are classified as nonflammable. In some implementations, a nonflammable bicycle lubricant may be an important safety feature for bicycle chain oils which are often applied indoors in confined spaces where the risk of ignition may be present. In some implementations, nonflammable bicycle lubricants may be an important feature for transportation and storage.

In some implementations, the lubricant may be non-toxic. Canola oil and castor oil are both obtainable as food-grade products. Many poly-alpha-olefins and polyalkylene glycols are used in a variety of personal care products and are considered safe in case of incidental food contact. In some implementations, due to the importance of maintaining the safety of users applying these lubricants, the components should be classified as either H-1 or H-2 and approved by the United States Department of Agriculture (USDA). Organizations such as NSF International use these classifications to protect consumers and ensure products are certified and meet safety specifications. H-1 is a stringent classification for lubricants approved for incidental food contact. The H-2 classification is for uses where there is no possibility of food contact and seeks to assure that no known poisons or carcinogens are used in the lubricant. In some implementations, the present bicycle oils may be formulated to meet H-1 and H-2 classification. H-1 approved oil and the term "food grade" will be used interchangeably for the purpose of this application.

In some implementations, the lubricant may pick up minimal dirt particles from road and trail surfaces. In some implementations, the lubricant may not wash off when riding in wet conditions. In some implementations, the lubricant may be formulated so that the chain can be easily cleaned with a rag leaving behind a minimal residue.

A number of implementations have been described. Nevertheless, it will be understood that various modifications may be made without departing from the spirit and scope of the disclosures in this application. As a non-limiting example, additional components may be added to those described above, or components may be removed or rearranged.

Other implementations are within the scope of the following claims.

What is claimed is:

1. A lubricant comprising food grade based oils substantially complying with USDA H-1 specifications for incidental contact with food, wherein at least one oil is selected from the group consisting of food grade plant oil, food grade poly-alpha-olefin, polyalkylene glycol, and mixtures thereof, wherein the lubricant has an absolute viscosity of about 50 to 450 centipoise at about 21 degrees Celsius wherein lubricant comprises canola oil comprising about 10 weight percent to about 80 weight percent, and castor oil comprising about 10 weight percent to about 80 weight percent and the food grade poly-alpha-olefin comprises about 1 weight percent to about 10 weight percent.

2. The lubricant of claim 1, further comprising an antioxidant in an amount equal to or less than about 5.0 weight percent.

3. The antioxidant of claim 2, wherein the antioxidant comprises a mixture of at least one item selected from the group consisting of tocopherols and tocotrienols, butylated hydroxytoluene, butylated hydroxyanisole and omega 3 fatty acids.

4. The lubricant of claim 1, further comprising a dye in an amount equal to or less than about 0.1 weight percent.

5. The dye of claim 4, wherein the dye is at least one dye selected from the group consisting of D&C Yellow #11, D&C Green #6, D&C Red #17, paprika oleoresin, annatto and chlorophyll.

6. The lubricant of claim 1, wherein the food grade plant oils comprise at least one oil selected from the group consisting of castor oil, soybean oil, sesame seed oil, rape seed oil, peanut oil, palm oil, olive oil, neatstool oil, menhadden oil, linseed oil, cotton seed oil, corn oil, coconut oil, sunflower oil, safflower oil and castor oil.

7. The lubricant of claim 1, wherein the food grade lubricant is applied to a chain of a bicycle.

8. A lubricant comprising canola oil, castor oil and a poly-alpha-olefin, the lubricant having an absolute viscosity ranging from about 50 centipoise to about 450 centipoise at about 21 degrees Celsius, wherein the canola oil comprises about 10 weight percent to about 80 weight percent, the castor oil comprises about 10 weight percent to about 80 weight percent and the poly-alpha-olefin comprises about 1 weight percent to about 10 weight percent.

9. The lubricant of claim 8 further comprising a dye in an amount equal to or less than about 0.1 weight percent.

10. The lubricant of claim 9, wherein the dye is at least one dye selected from the group consisting of D&C Yellow #11, D&C Green #6, D&C Red #17, paprika oleoresin, annatto and chlorophyll.

11. The lubricant of claim 9, wherein the canola oil comprises 80 weight percent, the castor oil comprises 10 weight percent and the poly-alpha-olefin comprises 10 percent.

12. The lubricant of claim 9, wherein the canola oil comprises 45 weight percent, the castor oil comprises 45 weight percent and the poly-alpha-olefin comprises 10 weight percent.

13. The lubricant of claim 9, wherein the canola oil comprises 15 weight percent, the castor oil comprises 75 weight percent and the poly-alpha-olefin comprises 10 weight percent.

14. The lubricant of claim 8, wherein the poly-alpha-olefin has a viscosity range from 22 to 150 centistokes at 40 degrees Celsius.

15. A lubricant comprising canola oil, castor oil and a polyalkylene glycol, the canola oil comprises about 10 weight percent to about 80 weight percent, the castor oil comprises about 10 weight percent to about 80 weight percent and the polyalklene glycol comprises about 1 weight percent to about 20 weight percent—the lubricant having an absolute viscosity ranging from about 50 centipoise to about 450 centipoise at about 21 degrees Celsius.

16. The lubricant of claim 15, further comprising a dye in an amount equal to or less than about 0.1 weight percent.

17. The lubricant of claim 15 wherein the lubricant is applied to a chain of a bicycle.

18. The lubricant of claim 17, wherein the canola oil comprises 80 weight percent, the castor oil comprises 10 weight percent and the polyalkylene glycol 10 percent.

19. The lubricant of claim 17, wherein the lubricant comprises 40 weight percent canola oil, 50 weight percent castor oil and 10 percent polyalkylene glycol.

20. The lubricant of claim 17, wherein the lubricant comprises 10 weight percent canola oil, 80 weight percent castor oil and 10 percent polyalkylene glycol.

21. The lubricant of claim 15, wherein the polyalkylene glycol has a viscosity range from 130 to 225 centistokes at 40 degrees Celsius.

* * * * *